US006060825A

United States Patent [19]

Kim

[11] Patent Number: 6,060,825

[45] Date of Patent: May 9, 2000

[54] COLOR CATHODE RAY TUBE INNER SHIELD AND METHOD FOR FABRICATING THE SAME

[75] Inventor: Sang-Mun Kim, Kyungsangbuk-do, Rep. of Korea

[73] Assignee: LG Electronics, Inc., Seoul, Rep. of Korea

[21] Appl. No.: 09/061,799

[22] Filed: Apr. 16, 1998

[30] Foreign Application Priority Data

Apr. 16, 1997 [KR] Rep. of Korea ..... 97-14054
Apr. 16, 1997 [KR] Rep. of Korea ..... 97-14055
Apr. 16, 1997 [KR] Rep. of Korea ..... 97-14057

[51] Int. Cl.[7] ..... H01J 31/00

[52] U.S. Cl. ..... 313/479; 313/402; 174/36; 174/35 MS

[58] Field of Search ..... 313/479, 402, 313/326; 174/35 R, 36, 35 GC, 35 MS

[56] References Cited

U.S. PATENT DOCUMENTS 5,434,470 7/1995 De Wit et al. ..... 174/35 MS X
5,557,161 9/1996 Van Mensvoort ..... 313/479
5,880,555 3/1999 Park ..... 313/479 X

FOREIGN PATENT DOCUMENTS 59-040444 6/1984 Japan .

*Primary Examiner*—Ashok Patel
*Attorney, Agent, or Firm*—John P. White; Cooper & Dunham LLP

[57] ABSTRACT

Method for fabricating an inner shield for use in a color cathode ray tube, is disclosed, for preventing degradation of a color finesse of the color cathode ray tube, the method including the steps of drawing or forming a piece of thin sheet of aluminum killed steel to form an inner shield of required form, annealing the inner shield in a reducing atmosphere at a temperature above a recrystallization temperature of the aluminum killed steel for improving a non-uniform magnetic distribution thereof, and coating black ironoxide film on a surface of the annealed inner shield.

1 Claim, 7 Drawing Sheets

(X50)

(X50)

COLOR CATHODE RAY TUBE INNER SHIELD AND METHOD FOR FABRICATING THE SAME

BACKGROUND OF THE INVENTION

1. Field of the Invention

The present invention relates to a color cathode ray tube inner shield and a method for fabricating the same, and more particularly, to a color cathode ray tube inner shield and a method for fabricating the same, which can prevent aberration of electron beams caused by external magnetic field.

2. Discussion of the Related Art

In general, as shown in FIG. 1, the color cathode ray tube is provided with a panel 1 having an inside surface coated with a fluorescent film, and a funnel 2 having an inside surface coated with conductive graphite, both of which are bonded with a fusion glass in a furnace at about 450° C. The funnel 2 has a neck part 3 in which electron guns 7 are mounted for emitting electron beams 9 and deflection yokes 8 mounted on an outside circumference thereof. A shadow mask 4, which is an electrode for selecting a color, is mounted inside of the panel 1 supported by a frame 5. There is an inner shield 6, which is a body for shielding a magnetic field, mounted inside of the shadow mask 4 for preventing aberration of the electron beams 9 due to the terrestrial magnetic field.

The operation of the aforementioned cathode ray tube will be explained.

Upon reception of a video signal, thermal electrons are emitted from cathodes in the electron gun 7 and travel towards the panel 1 while being accelerated and converged by acceleration and focusing electrodes. In this instance, the electron beams 9 are regulated of their paths by the deflection yokes 8 to be directed on a spot of the panel 1. The regulated electron beams are selected of a color while passing through a slot in the shadow mask 4 and collide onto the fluorescent film on the inside surface of the panel 1, to generate a fluorescent light, thereby reproducing the video signal. In the meantime, the electron beams 9 emitted from the electron gun 7 are influenced by the terrestrial field to be deviated from their normal paths. That is, the electron beams 9 passed through the shadow mask 4 are deviated from their normal paths and collide on a color other than intended to degrade an image due to lack of a counter measure for a component of the terrestrial field entering into the color cathode ray tube in a horizontal direction, i.e., in an axial direction of the color cathode ray tube. In order to solve this problem, the inner shield 6, which is a magnetic field shielding body of a feeble magnetism, is provided rear of the shadow mask 4. That is, as shown in FIGS. 2 and 3, an external magnetic field infiltering into the cathode ray tube is induced to flow along the inner field 6, preventing infiltering of the external magnetic field into an inner side of the color cathode ray tube.

However, a complete shielding of the axial component of the terrestrial field of the color cathode ray tube by means of the inner shield has been difficult because of its limit in its magnetic properties. Namely, the inner shield is formed of pure iron, for example, of aluminum killed steel(AK steel) having a carbon content reduced therefrom, by subjecting to continuous casting, hot rolling, cold rolling, and decarburization annealing, to obtain a thin sheet, which is then subjected to drawing or forming to an intended form. As the inner shield is formed of aluminum killed steel having a carbon content reduced therefrom, of the magnetic properties, the inner shield has a permeability, which determines an intensity of a magnetic flux flowing inside of a body, below 3000 and a coercive force below 1.5 Oe. Because a degree of magnetic shielding is dependent on the permeability, the inner shield with 3000 permeability has a limitation in shielding the external magnetic field. Particularly, the external magnetic field infiltering into the cathode ray tube concentrates on corners of the cathode ray tube and, therefrom, inflows into the cathode ray tube, giving an influence to the electron beams to deviate from the normal path, leading to a mislanding of the electron beams, that resulting in degradation of a finesse of an image on the cathode ray tube. Moreover, the severe mechanical deformation at the corners of the inner shield occurred at the thin sheet drawing or forming significantly degrades magnetic properties of the deformed portions, with a non-uniformity in overall magnetic properties of the inner shield, causing the aberration of the electron beams more severe and degrading the finesse more.

SUMMARY OF THE INVENTION

Accordingly, the present invention is directed to a color cathode ray tube inner shield and a method for fabricating the same that substantially obviates one or more of the problems due to limitations and disadvantages of the related art.

An object of the present invention is to provide to a color cathode ray tube inner shield and a method for fabricating the same, which has improved magnetic properties capable of shielding an influence from an external magnetic field for preventing a degradation of a finesse.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for fabricating an inner shield for use in a color cathode ray tube includes the steps of forming an inner shield of required form with a thin sheet of aluminum killed steel, annealing the inner shield in a reducing atmosphere at a temperature above a recrystallization temperature of the aluminum killed steel for improving a non-uniform magnetic distribution thereof, and coating black ironoxide film on a surface of the annealed inner shield.

In other aspect of the present invention, there is provided a method for fabricating an inner shield for use in a color cathode ray tube, including the steps of subjecting a piece of aluminum killed steel to continuous casting, hot rolling, cold rolling and decarburization annealing to form a thin sheet of aluminum killed steel, subjecting the thin sheet of aluminum killed steel to annealing in a reducing atmosphere for forming over 40% of {III} texture and growing crystal grains greater than 60 $\mu$m therein, forming an inner shield with the annealed thin sheet to a required form, and coating black ironoxide film on a surface of the inner shield.

The annealing is preferably conducted in a magnetic field.

In another aspect of the present invention, there is provided an inner shield for use in a color cathode ray tube for shielding an external magnetic field, formed to have over 40% of {III} texture and crystal grains greater than 60 $\mu$m for improving a non-uniform magnetic distribution.

An inner shield formed thus can prevent degradation of a color finesse because a magnetic permeability can be increased and a dielectric constant can be decreased, with an improvement in the magnetic field shielding capability.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
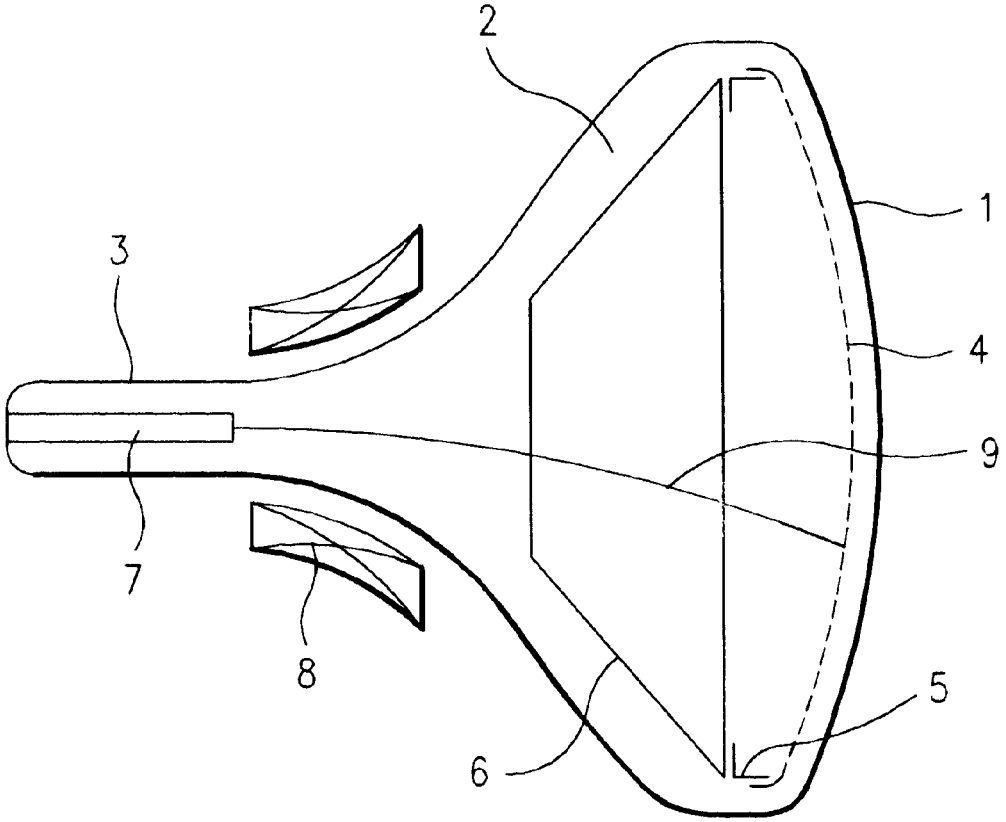
FIG. 1 Background Art
FIG. 1 illustrates a section showing a general color cathode ray tube, schematically.
Figure 2:
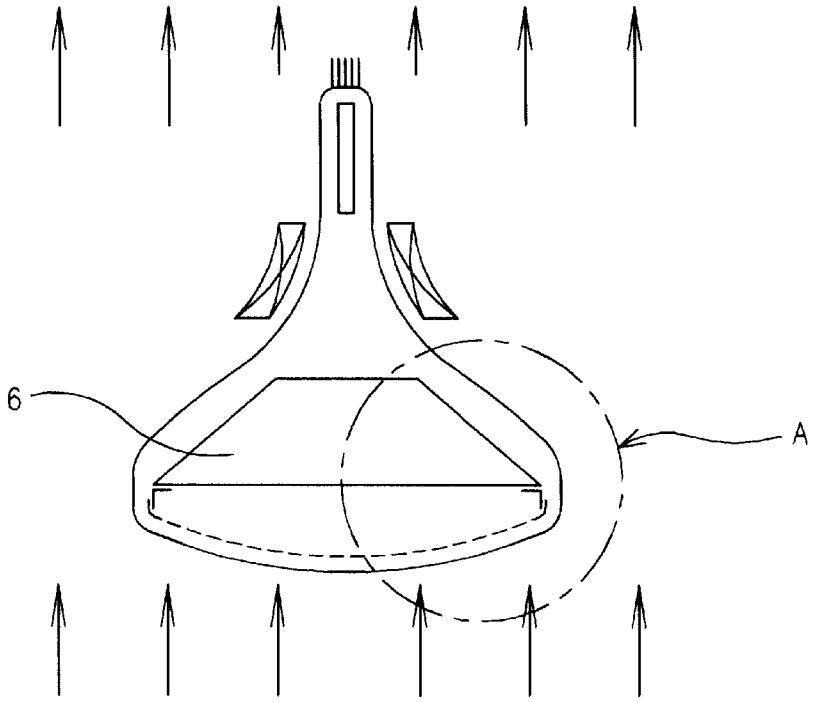
FIG.2 Background Art
FIG. 2 illustrates a flow state of an external magnetic field infiltering into a color cathode ray tube.
Figure 3:
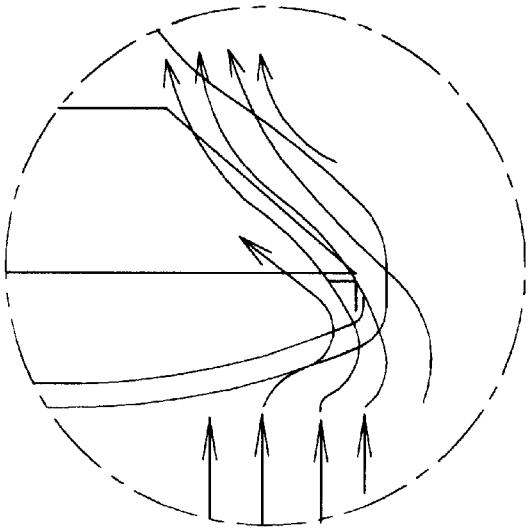
FIG.3 Background Art
FIG. 3 illustrates an enlarged view of "A" part in FIG. 2.

Reference will now be made in detail to the preferred embodiments of the present invention, examples of which are illustrated in the accompanying drawings.

First Embodiment

A method for fabricating an inner shield in a cathode ray tube in accordance with a first preferred embodiment of the present invention includes the steps of drawing or forming a thin sheet of aluminum killed steel into an inner shield, subjecting the inner shield to an annealing in a reducing atmosphere at an elevated temperature higher than a recrystallization temperature of the aluminum killed steel for improving a non-uniform magnetism distribution in the inner shield, and coating a surface of the inner shield having subjected to annealing with black ironoxide film, which will be explained in detail, below.

A piece of pure steel from aluminum killed steel of a feeble magnetism is subjected to continuous casting, hot rolling, cold rolling and decarburization annealing to form a thin sheet which is then subjected to drawing or forming to form an inner shield. Namely, the process up subjecting a thin sheet of aluminum killed steel of feeble magnetism to drawing or forming to form an inner shield is the same with the background art method of fabricating an inner shield. Then, the formed inner shield is subjected to annealing in an atmosphere with no oxygen at a certain elevated temperature. In order to provide the atmosphere with no oxygen in the annealing, an atmosphere using a vacuum, hydrogen gas, a mixture gas of hydrogen and nitrogen, or mixture gas of hydrogen and ammonia gas is provided, because presence of oxygen in the annealing process oxidizes a surface of the inner shield, impeding formation of an inner shield having a desired magnetic properties. The annealing is conducted at a temperature above the recrystallization temperature of the aluminum killed steel, i.e., above 500° C., and preferably, at a temperature within a range of 700° C.~1000° C., because, if the annealing is conducted at a temperature below the recrystallization temperature of the aluminum killed steel, not only crystals in the inner shield can not grow though the crystals can be rearranged partially within the inner shield, but also an alteration of the magnetic properties can not be expected due to diffusion of impurities contained in the inner shield. Thus, the annealing should be conducted at a temperature above the recrystallization temperature for easy recrystallization in the inner shield with subsequent grain growth of the crystals, resulting to an alteration of magnetic properties. It was found that, as the annealing temperature is the higher, grain growth of the crystals becomes the faster, significantly improving the magnetic permeability and reducing the coercive force to improve the magnetic shielding performance of the inner shield significantly, and as the annealing temperature is the lower, a time period for recrystallization is prolonged the more, and the magnetic properties are improved the more as the grain is grown the more. The annealing is conducted for more than one minute, because, if the annealing is conducted less than one minute, the grain growth can not be occurred after the recrystallization. Thus, when the inner shield is subjected to annealing after the formation, the magnetic properties of the inner shield is stabilized and improved. Accordingly, the present invention can improve a shielding performance against an external magnetic field, reducing mislanding of the electron beams in the cathode ray tube, which gives an influence to a finesse of an image on the cathode ray tube. This principle can be applicable to X-, Y- and Z-axis of the cathode ray tube in the same fashion. Thus, by restoring a structural deformation occurred in the formation of the inner shield and growing crystal grains by means of annealing, desired magnetic properties can be obtained. The black ironoxide film coating improves heat radiation.

In order to see effects of the present invention, inner shields annealed under conditions, example 1, example 2 and example 3 are compared with the background art inner shield which is not annealed in terms of their magnetic properties. That is, referring to FIG. 4, their magnetic permeabilities and coercive forces are measured for portions at corners(b), long side(a) and short side(c). And, mislandings are measured for a color cathode ray tube having the inner shield of the present invention applied thereto while varying a terrestrial field, of which results are shown in TABLE 1 and TABLE 2, below.

TABLE 1

| | annealing condition | black ironoxide film coating |
|---|---|---|
| example 1 | $H_2$ atmosphere, 900° C., 20 min. | Propane atmosphere at 600° C. |
| example 2 | $H_2$ 50% + $NH_3$ 50% atmosphere, 800° C., 20 min. | |
| example 3 | $H_2$ 70% + $NH_3$ 30% atmosphere, 750° C., 50 min. | |
| comparative | no annealing | |

TABLE 2

| | example 1 | example 2 | example 3 | comparative |
|---|---|---|---|---|
| | magnetic permeability | | | |
| 1. corner | 9400 | 8900 | 6700 | 850 |
| 2. long side | 9600 | 9000 | 6900 | 1350 |
| 3. short side | 9350 | 8800 | 7000 | 1300 |
| | coercive force Oe | | | |
| 1. corner | 0.59 | 0.59 | 0.76 | 4.56 |
| 2. long side | 0.52 | 0.62 | 0.72 | 2.27 |
| 3. short side | 0.6 | 0.64 | 0.75 | 2.4 |

Figure 5:
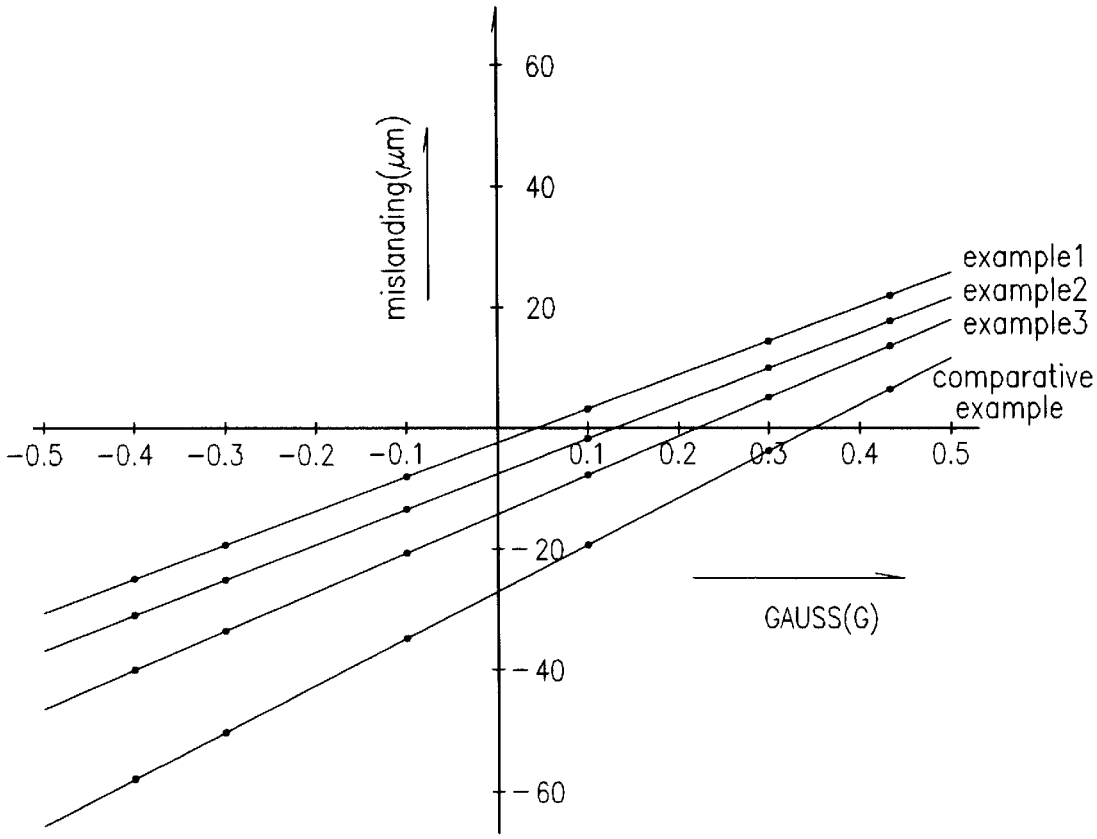
FIG. 5 illustrates a graph showing comparison of mislanding of a cathode ray tube having an inner shield in accordance with a preferred embodiment of the present invention and a background art cathode ray tube.

Referring to TABLE 2, it can be known from the results of the measurements that the inner shields of the present invention(examples 1, 2 and 3) have magnetic permeabilities, being above 6000, significantly improved than the background art inner shield which is not annealed after the formation while their coercive forces are decreased. It can be also known that the inner shield of the present invention has a substantially uniform permeabilities and coercive forces at the long side (a), the short side (c) and the corner (b). That is, it can be known that the inner shield of the present invention has a uniform permeability and coercive force throughout the inner shield, with improved permeability and magnetic field shielding capability. And, as shown in FIG. 5, though the cathode ray tube having the background art inner shield applied thereto shows a great mislanding, the cathode ray tube having the inner shield of the present invention applied thereto shows a significantly reduced mislanding. Thus, by applying the inner shield of the present invention to a color cathode ray tube, not only uniform magnetic properties, but also improvements in the magnetic properties can be obtained, reducing mislanding which affect finesse of the color cathode ray tube, allowing to prevent degradation of the finesse.

Second Embodiment

Though, in the first embodiment, the inner shield is annealed after formation for improving its magnetic field shielding performance, the present invention is not limited to this. For example, the thin sheet of aluminum killed steel may be annealed before formation into the inner shield. That is, a method for fabricating an inner shield in a color cathode ray tube in accordance with a second embodiment of the present invention includes the steps of subjecting a piece of aluminum killed steel to continuous casting, hot rolling, cold rolling and decarburization annealing, subjecting the aluminum killed steel to annealing to form an annealed thin sheet with {III} texture over 40% and crystal grain sizes greater than 60 $\mu$m, forming an inner shield with the annealed thin sheet, and coating the formed inner shield with black ironoxide film. The inner shield may be formed by drawing or forming as the background art.

This method for fabricating an inner shield in a color cathode ray tube in accordance with a second embodiment of the present invention will be explained in detail. Melt of the aluminum killed steel is subjected to continuous casting, hot rolling, and cold rolling to form a desired thickness of thin sheet, which is then subjected to decarburization annealing to reduce a carbon content to 0.004 wt %~0.001 wt %. Then, the thin sheet is subjected to annealing at a temperature above 700° C. for forming {III} texture and growing crystal grains in the aluminum killed steel. An annealing above the aforementioned temperature leads the aluminum killed steel, not only to cause a recrystallization to form the {III} texture, but also to cause subsequent crystal grain growth after the recrystallization, to alter its magnetic properties. On the contrary, if the annealing temperature is below 700° C., formation of the {III} texture can be hardly expected with a slow crystal grain growth. The crystal grain growth becomes the faster as the annealing temperature the higher, to improve the magnetic permeability and reduce the coercive force, thereby improving the magnetic field shielding capability, and as the annealing temperature the lower, the time period for recrystallization becomes the longer. Alike the first embodiment, in order to prevent the thin sheet from being oxidized, the annealing is conducted in a reducing atmosphere in which no oxygen makes reaction, i.e., in vacuum, hydrogen gas, a mixture gas of hydrogen and nitrogen, or a mixture gas of hydrogen and ammonia. The annealing time period, determined considering an extent of the {III} texture formation and an extent of the crystal grain growth, may be set longer than one minute at the aforementioned elevated temperature in a case of the thin film.

Figure 6:
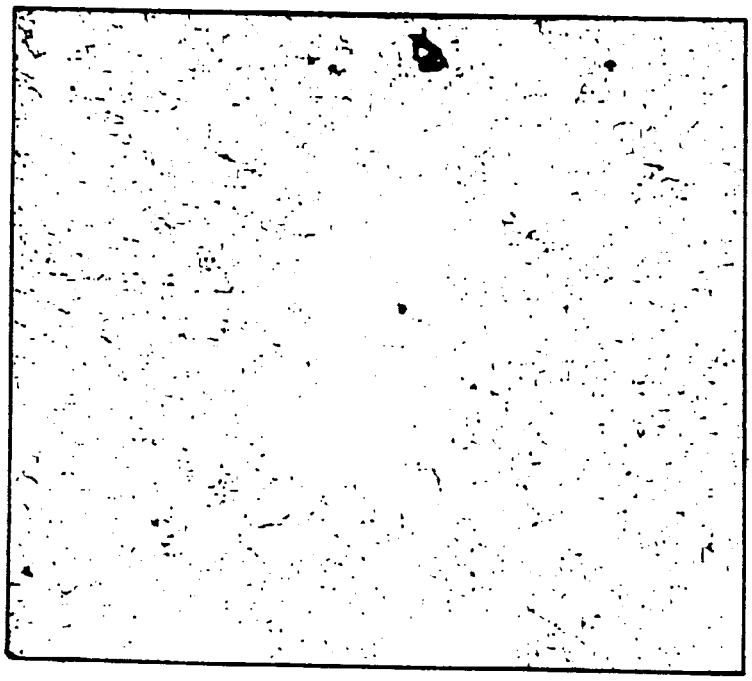
FIG. 6 illustrates a microscopic photograph showing crystal grains of a background art inner shield.
Figure 7:
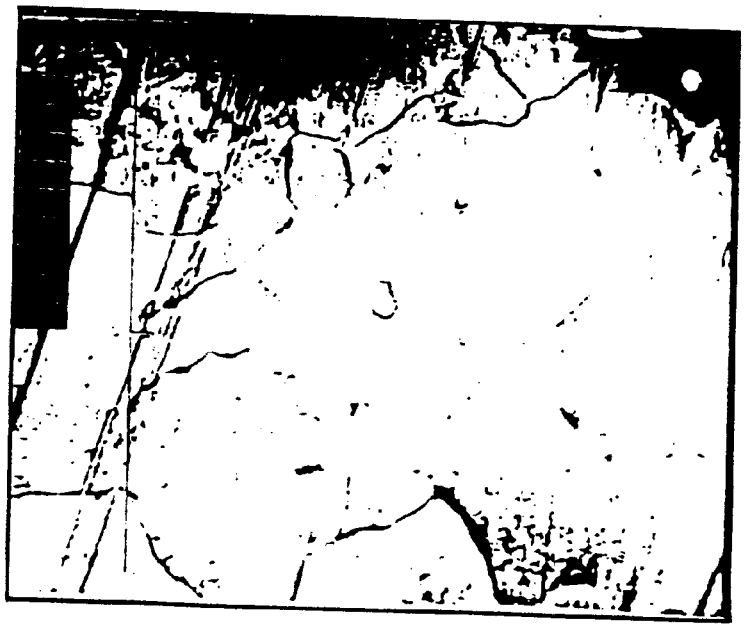
FIG. 7 illustrates a microscopic photograph showing crystal grains of an inner shield in accordance with a preferred embodiment of the present invention.

In the meantime, as a crystal plane of a pure iron, which is an aluminum killed steel of feeble magnetism, which is difficult to magnetize, i.e., a crystal plane through which a magnetic flux can flow with difficulty, is the {III} plane, the {III} texture is formed along the surface of the thin sheet for easy flow of the magnetic flux along the surface of the thin sheet, but not vertical to the surface. Because the above effect can not be expected with the {III} texture below 25%, the {III} texture is formed more than 25%. And, the magnetic properties are dependent on the crystal grain sizes, the crystal grains are formed greater than a certain sizes, i.e., greater than 60 $\mu$m. Because the annealing causes impurities, such as carbon, nitrogen, sulfur and aluminum within crystal grains to migrate to grain boundaries, resulting in each of the crystal grains to behavior as a single magnetic domain. Accordingly. as shown in FIG. 6, a number of crystal grains per unit area is increased, slowing down propagation of a magnetic field, i.e., transmission of magnetic spin from one crystal grain to another the much due to the impurities, with subsequent increase of the coercive force and reduction of the magnetic permeability, that degrades the magnetic field shielding capability. However, when the crystal grain sizes are greater than 60 $\mu$m, with a reduction of the number of crystal grains per unit area, the magnetic spin can be transmitted with easy, to increase the magnetic permeability and decrease the coercive force, thereby increasing the magnetic field shielding capability. In summary, both by forming over 40% of the {III} texture in the aluminum killed steel and an average crystal grain size over 60 $\mu$m, the magnetic field shielding capability can be improved. Then, the inner shield is formed by drawing or forming the thin sheet of aluminum killed steel formed by the aforementioned process. Upon coating the inner shield with black ironoxide film, the inner shield of the present invention is completed.

To see the effect of the inner shield in accordance with the second embodiment of the present invention, magnetic properties of inner shields annealed in conditions as example 1, example 2 and comparative example 1 in TABLE 3 below are compared to magnetic properties of an inner shield annealed in a condition as a comparative example 2 in TABLE 3. For analyzing an extent of the {III} texture in the crystal plane of the aluminum killed steel annealed in the conditions as TABLE 3, a pole figure is analyzed by an X-ray diffraction analyzer, and a ratio of volume of the crystal plane per unit volume is measured by an ODF (Orientation Distribution Function) analyzer, to asses the extent of aggregate of the crystal plane. And, a size of the crystal grain, initial magnetic permeability and coercive force are measured, resulting to obtain figures as shown in TABLE 4. And, mislanding is measured varying an intensity of the terrestrial field to color cathode ray tubes each having the inner shields fabricated in conditions as shown in TABLE 3, to obtain results as shown FIG. 8.

TABLE 3

| | annealing conditions |
|---|---|
| example 1 | hydrogen atmosphere, 850° C., 10 min. |
| example 2 | hydrogen 70% and ammonia 30% atmosphere, 800° C., 10 min. |
| comparative example 1 | hydrogen 30% and ammonia 70% atmosphere, 780° C., 5 min. |
| comparative example 2 | no annealing |

TABLE 4

| | example 1 | example 2 | comparative example 1 | comparative example 2 |
|---|---|---|---|---|
| {III} texture | 0.95 | 0.9 | 0.4 | 0.15 |
| crystal grain size | 120 μm | 95 μm | 50 μm | 35 μm |
| initial magnetic permeability | 9350 | 8800 | 1790 | 1300 |
| coercive force Oe | 0.6 | 0.64 | 1.75 | 2.4 |

Figure 4:
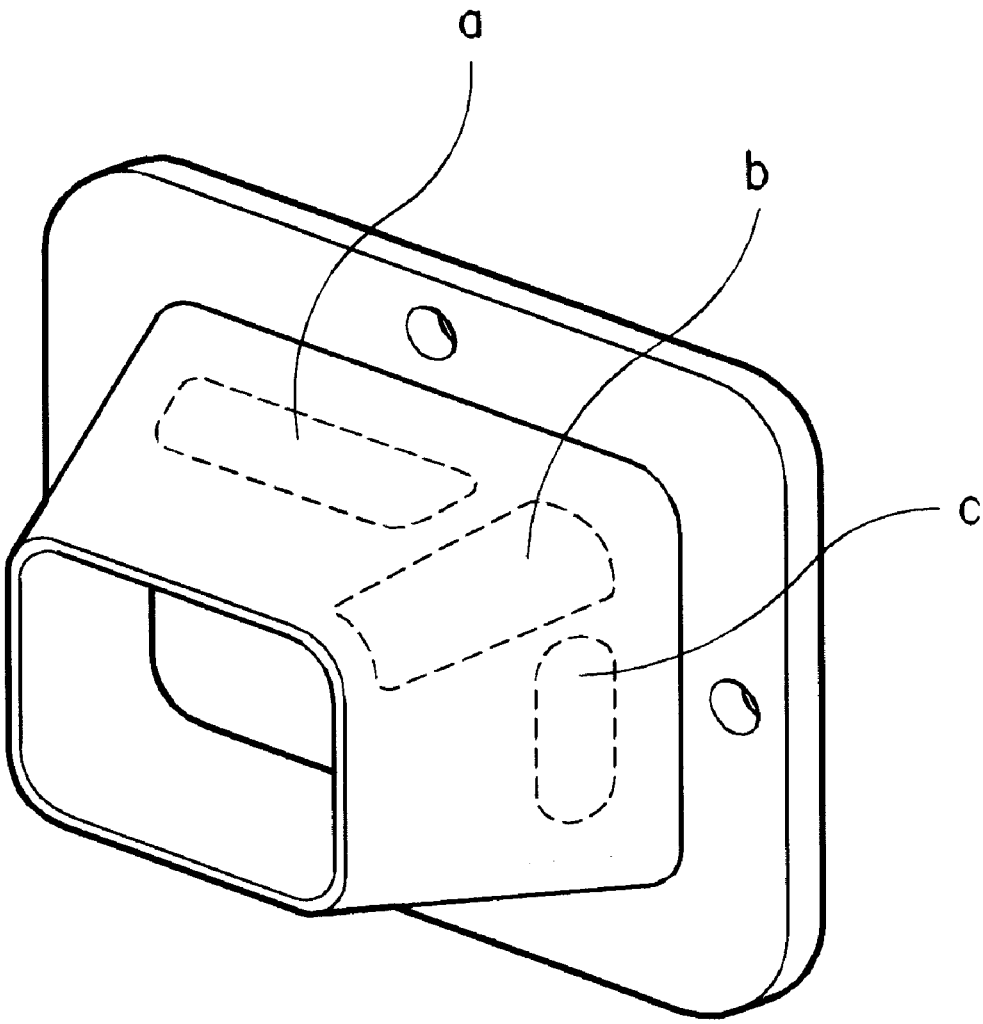
FIG. 4 illustrates a perspective view of an inner shield in accordance with a preferred embodiment of the present invention, showing positions therein of which magnetic properties are assessed.
Figure 8:
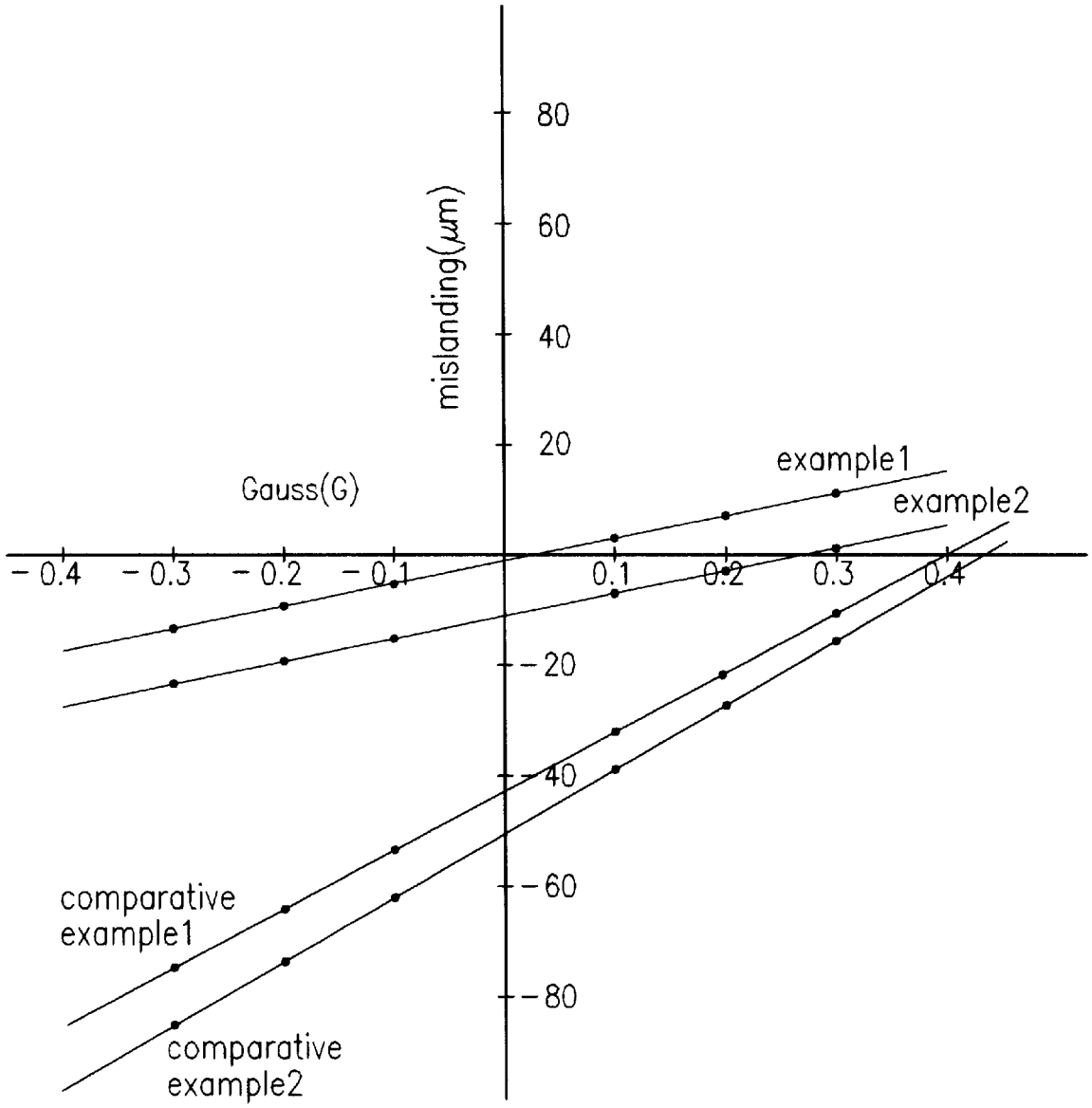
FIG. 8 illustrates a graph showing comparison of mislanding of a cathode ray tube having an inner shield in accordance with a second preferred embodiment of the present invention and a background art cathode ray tube; and, FIG. 9 illustrates a graph showing comparison of mislanding of a cathode ray tube having an inner shield in accordance with a third preferred embodiment of the present invention and a background art cathode ray tube.

Referring to FIG. 4, it can be known that, as the annealing temperature the higher, the ratio of volume in the {III} crystal plane as well as the crystal grain size are increased, with subsequent significant increase of the initial magnetic permeability and reduction of the coercive force, to improve the magnetic field shielding characteristic. However, it can also be known from the comparative example 1 that the improvement in the magnetic field shielding characteristic is little if the crystal grain size is not greater than 60 μm even if the aggregate extent of the {III} crystal plane is over 40% by the annealing at a temperature above 700° C. Therefore, it can be known that the annealing should be conducted such that the aggregate extent of the {III} crystal plane is over 40% as well as the crystal grain size is greater than 60 μm, for improvement in the magnetic field shielding characteristic. Referring also to FIG. 8, it can be known that the mislanding of the color cathode ray tube having the inner shield fabricated with the aluminum killed steel annealed at a temperature above 700° C. is less than the background art color cathode ray tube(the comparative example). As has been explained, it can be known that, when the {III} textures more than 40% in the surface of the thin film with an average crystal grain size grown greater than 60 μm by cold rolling and annealing aluminum killed steel of a body centered cubic lattice, it is effective in preventing a degradation of the color finesse because it improves the magnetic field shielding capability of an inner shield to reduce mislanding caused by an external magnetic field.

Third Embodiment

In this embodiment, the thin sheet of aluminum killed steel is annealed in a magnetic field as a variation from the second embodiment. A method for fabricating an inner shield in a color cathode ray tube of this embodiment is the same with the second embodiment except for the conduction of annealing in a magnetic field. As the considerations on annealing temperature, atmosphere, and time period etc., are the same with the second embodiment, explanations for those matters will be omitted. In the conduction of annealing in a magnetic field of this embodiment, the magnetic field may be generated either by using the solenoid principle such that the magnetic flux may flow along a direction of transportation of the cold rolled steel sheet in a continuous annealing furnace, or by placing permanent magnets such that poles of the same polarity face each other between which the cold rolled steel sheet is passed, for applying the magnetic field to the steel sheet while annealing and cooling down. An intensity of the magnetic field is higher than 100 Gauss. The annealing in the magnetic field causes a magnetic orientation of a structure within the aluminum killed steel to be uniform, to improve the magnetic properties.

Figure 9:
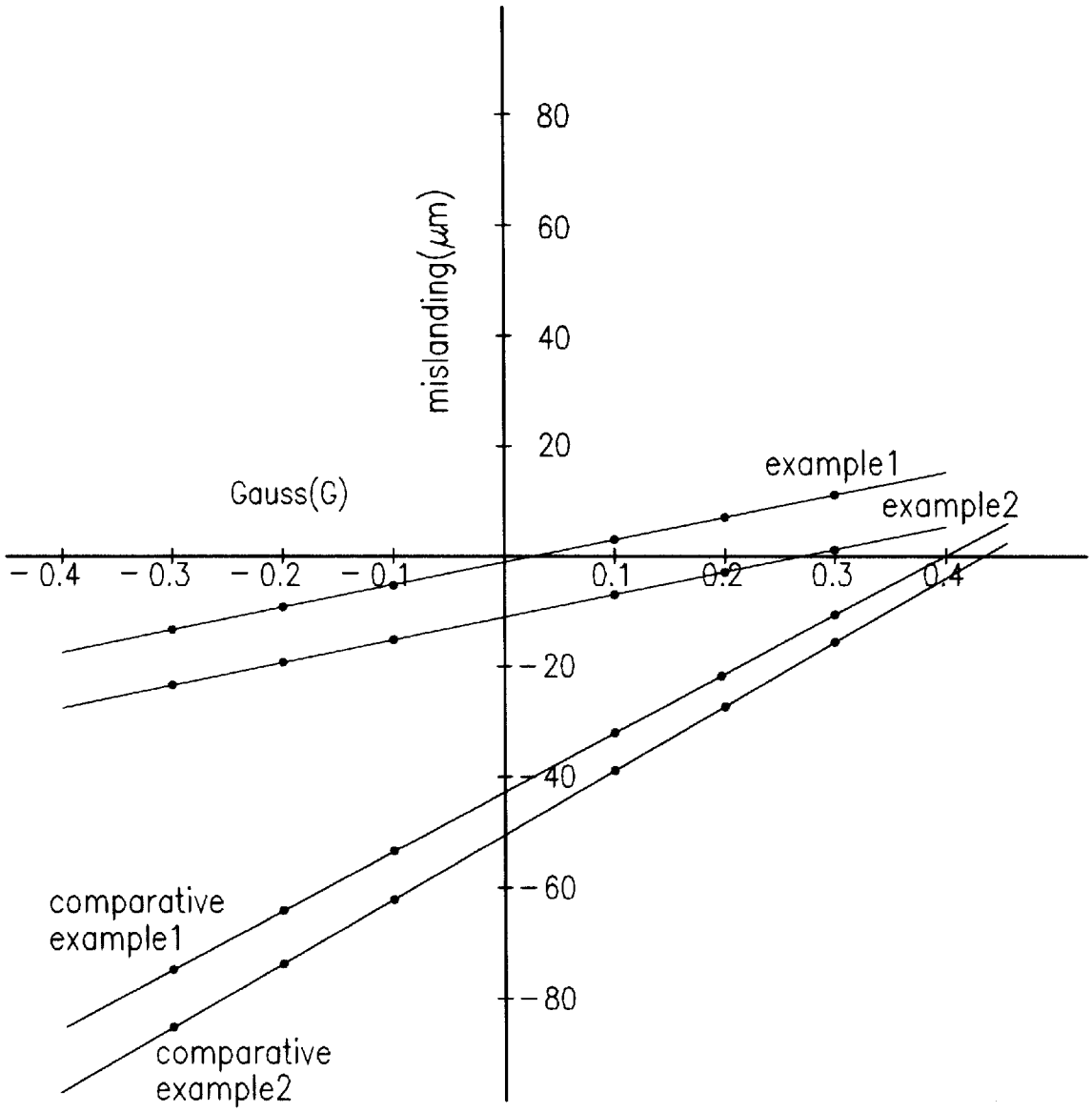

To see the effect of the inner shield in accordance with the third embodiment of the present invention, magnetic properties of inner shields annealed in conditions as example 1, example 2 and comparative example 1 as shown in TABLE 5 below are compared to magnetic properties of an inner shield annealed in a condition as a comparative example 2 in TABLE 3, like the second embodiment, of which results are shown in TABLE 6, and mislanding is measured varying an intensity of the terrestrial field to color cathode ray tubes each having the inner shields fabricated in conditions as shown in TABLE 5, to obtain results as shown FIG. 9.

TABLE 5

| | annealing conditions |
|---|---|
| example 1 | hydrogen atmosphere, 750° C., 20 min, 5000 Gauss |
| example 2 | $H_2$ 70% and $NH_3$ 30% atmosphere, 780° C., 10 min, 1000 Gauss |
| comparative example 1 | hydrogen 30% and ammonia 70% atmosphere, 850° C., 5 min |
| comparative example 2 | no annealing |

TABLE 6

| | example 1 | example 2 | comparative example 1 | comparative example 2 |
|---|---|---|---|---|
| {III} texture | 0.95 | 0.9 | 0.4 | 0.15 |
| crystal grain size | 120 μm | 95 μm | 90 μm | 35 μm |
| initial magnetic permeability | 13450 | 136800 | 6400 | 1300 |
| coercive force Oe | 0.4 | 1.34 | 0.8 | 2.4 |

Referring to TABLE 6, it can be known that the volume ratios of the {III} textures are increased in the cases of inner shields annealed in a magnetic field(example 1 and example 2) in comparison to the case of inner shield annealed without application of the magnetic field (comparative example 1), exhibiting their initial magnetic permeabilities greater than 10,000, with significant improvement in their magnetic characteristics. And, it can be known that the color cathode ray tube having the inner shields of TABLE 6 applied thereto is excellent in the mislanding characteristic than the comparative example. As has been explained, this embodiment is effective in improvement of the magnetic characteristics of the inner shield than the case the inner shield is annealed without application of the magnetic field, to reduce the mislanding caused by an external magnetic field, with subsequent prevention of degradation of the color finesse.

It will be apparent to those skilled in the art that various modifications and variations can be made in the color cathode ray inner shield and a method for fabricating the same of the present invention without departing from the spirit or scope of the invention. Thus, it is intended that the present invention cover the modifications and variations of this invention provided they come within the scope of the appended claims and their equivalents.

What is claimed is:

1. An inner shield for use in a color cathode ray tube for shielding an external magnetic field, the inner shield being formed to have over 40% of {III} texture and crystal grains greater than 60 $\mu$m for improving a non-uniform magnetic distribution.

* * * * *